US005211242A

United States Patent [19]

Coleman et al.

[11] Patent Number: 5,211,242

[45] Date of Patent: May 18, 1993

[54] APPARATUS AND METHOD FOR UNLOADING PRODUCTION-INHIBITING LIQUID FROM A WELL

[75] Inventors: Malcolm W. Coleman, Katy; J. Byron Sandel, Huntsville, both of Tex.

[73] Assignee: Amoco Corporation, Chicago, Ill.

[21] Appl. No.: 779,678

[22] Filed: Oct. 21, 1991

[51] Int. Cl.[5] ..... E21B 43/00; E21B 43/18

[52] U.S. Cl. ..... 166/372; 166/64; 166/68; 166/106; 166/107

[58] Field of Search ..... 166/372, 370, 106, 105, 166/105.1, 68, 64; 417/54, 55, 118, 143, 137

[56] References Cited

U.S. PATENT DOCUMENTS

| | | | |
|---|---|---|---|
| 4,509,599 | 4/1985 | Chenoweth et al. | 166/370 |
| 4,527,633 | 7/1985 | McLaughlin et al. | 166/370 |
| 4,844,156 | 7/1989 | Hesh | 166/372 |

OTHER PUBLICATIONS

Pp. 125-131, *The Technology of Artificial Lift Methods-vol. 2, by Kermit Brown, (1977).*

Pp. 63 and 64, "4 new ways to reduce artificial lift expense", *World Oil*, by E. E. DeMoss, (1973).

"Down-Hole Chambers Increase Gas-Lift Efficiency", *The Petroleum Engineer*, by H. W. Winkler and George F. Camp, (part 1-Jun., 1956; part 2-Aug. 1956).

Pp. 7-001-7-015, Chapter VII, "Chamber Design", CAMCO Gas Lift Manual, H. W. Winkler and S. S. Smith (1962).

SPE 9913, "Lifting of Heavy Oil With Inert-Gas-Operated Chamber Pumps", by John T. Dewan and John Elfarr, (1981).

*JPT*, "A New Look at Predicting Gas-Well Load-Up", by Steve B. Coleman, Hartley B. Clay, David G. McCurdy and H. Lee Norris III, (Mar., 1991).

*JPT*, "Understanding Gas-Well Load-Up Behavior", by Steve B. Coleman, Hartley B. Clay, David G. McCurdy and H. Lee Norris III, (Mar., 1991).

*JPT*, "Applying Gas-Well Load-Up Technology", by Steve B. Coleman, Hartley B. Clay, David G. McCurdy and H. Lee Norris III, (Mar., 1991).

"Liquid Removal from Gas Wells-Gas Lifting with Reservoir Gas" by E. E. DeMoss and P. W. Orris, (Apr. 1968).

*Primary Examiner*—Stephen J. Novosad

*Attorney, Agent, or Firm*—James A. Gabala; Richard A. Kretchmer; Frank J. Sroka

[57] ABSTRACT

A chamber in a well is connected to two externally separate tubing strings to unload liquid which is applying backpressure against a formation so that the production of fluid from the formation is obstructed. Volumes of the liquid are intermittently collected in the chamber and lifted out of the well through one of the tubing strings in response to high pressure gas injected solely into the chamber through the other tubing string.

24 Claims, 6 Drawing Sheets

APPARATUS AND METHOD FOR UNLOADING PRODUCTION-INHIBITING LIQUID FROM A WELL

BACKGROUND OF THE INVENTION

This invention relates generally to an apparatus and method for unloading production-inhibiting liquid from a well and more particularly to a gas lift technique for intermittently removing water which limits the flow of natural gas from a subterranean formation.

One way to produce gas from a well is by depletion or volumetric drive. Gas is driven from the well by pressure naturally existing within the formation from which the gas comes. Over time, however, the formation pressure typically declines sufficiently that it cannot overcome the backpressure exerted by liquids which may accumulate in the well adjacent the formation.

In producing gas, water typically condenses and falls out of the upwardly flowing stream of gas being produced out of the well. Over time, this water will accumulate in the well across the formation. This restricts flow out of the formation, and in some cases at least, this can stop further production altogether. Even where some production can still occur, it may be uneconomical to continue it. In some wells, even a relatively small amount of water falling out of the gas production stream can have this detrimental effect.

Where this condition prevents economic production by formation pressure alone, either the well is abandoned or another means of recovering the gas from the formation must be used. The latter is done if the cost of recovery is less than the value of what is recovered.

Techniques which have been used or proposed to try to meet this cost versus value criterion include using soap sticks, "pitting" the well occasionally (blowing the well down in a pit to atmospheric pressure), swabbing, injecting high pressure gas in the formation, lowering the end of a tubing string to the perforations, tapering the tubing string to a smaller inner diameter near the surface to increase rate of flow, optimizing tubing size to balance velocity and friction effects, using plunger lift, waterflooding the formation to augment pressure depletion, insulating and heating the production tubing string to minimize condensation and liquid fallout, and beam lifting. "Stop cocking," wherein the annulus of the well is closed so that pressure increases in response to formation pressure migrating through the accumulated liquid or unaffected portions of the formation until it can drive the liquid down the annulus and up a communicating tubing string, is another known technique.

Whether any of the foregoing is appropriate for a given case depends on the specific well conditions. For example, at least some of the foregoing require a substantial initial investment, and at least some require sufficient formation energy to lift the obstructing liquid.

Another known technique is gas lift, wherein at least a portion of the liquid is collected in a chamber and then a pressurized gas is injected into the chamber from outside the well to lift collected liquid out of the well through a lift tubing string communicating with the chamber. The chamber is defined either by two spaced packers and the intervening length of the well (e.g., a casing or liner) or by a vessel connected to the lift tubing string. The pressurized gas is injected into the chamber either through the annulus or an injection tubing string. Thus, either a single tubing string is used, or two tubing strings are used. The dual tubing string methods we are aware of have the strings either embedded one within the other or externally adjacent to each other but interconnected to communicate between the two tubing strings above where the strings connect to the chamber. These implementations provide relatively limited increased production because they produce only through the relatively small diameter lift tubing or they do not produce during the lift cycle. With regard to the dual string implementations, in particular, the ones we are aware of require relatively complex crossover elements or multiple standing valves. These can increase maintenance problems and cost.

Although the foregoing techniques can be useful in particular applications, there is still the need for an improved apparatus and method for unloading production-inhibiting liquid from a well to have utility at least in part where the previously known techniques may not be suitable. Such an improved technique should preferably be suitable for efficiently unloading at least relatively small amounts of liquid from low pressure formations which are deep enough that it may not be economical to use other production techniques but not so deep that the necessary amount of liquid cannot be economically lifted by gas injected from a source outside the well. Thus, the improved technique should provide an external source of energy to lift liquid out of the well; however, the energy should be confined to avoid injecting high pressure gas into the formation. The improved technique should also provide for maximum production and reduced friction pressure by allowing continuous gas flow up the well annulus. The improved technique also should be capable of use below perforations into the formation to reduce formation hydrostatic backpressure. To reduce cost and to facilitate installation, use and maintenance, the improved technique should also be relatively simple.

SUMMARY OF THE INVENTION

The present invention overcomes the above-noted and other shortcomings of the prior art and meets the foregoing needs by providing a novel and improved apparatus and method for unloading production-inhibiting liquid from a well.

The present invention provides a gas lift apparatus for installation in a well extending into the ground from the surface and intersecting a natural gas-bearing formation below the surface for intermittently removing separate volumes of liquid from the well for increasing the flow of natural gas from the formation into the well. This apparatus comprises: chamber means for receiving liquid from the well and for receiving pressurized gas from outside the well; an injection tubing string for conducting pressurized gas to the chamber means from outside the well to provide a lift pressure in the chamber means, the injection tubing string connected to the chamber means; and a production tubing string, connected to the chamber means, for conducting liquid from the chamber means out of the well in response to the lift pressure, the injection and production tubing strings disposed outside each other so that the injection and production tubing strings communicate with each other in the well only through the chamber means.

The present invention provides a method of gas-lifting liquid from a well extending into the ground from the surface and intersecting a natural gas formation below the surface for intermittently removing separate volumes of liquid from the well for increasing the flow of natural gas from the formation into the well while permitting production of natural gas through the well. The method comprises: injecting, for a limited time period and through an injection tubing string extending from the surface, pressurized gas into a liquid-containing chamber located in the well adjacent the formation and connected to the injection tubing string; lifting, in response to the injected pressurized gas and during the limited time period, liquid in the chamber out of the well through a production tubing string connected to the chamber, which production tubing string and injection tubing string are located outside of each other and in fluid isolation from each other within the well except through the chamber; and producing natural gas from the formation through the well outside the injection and production tubing strings.

As a result of using the present invention, the preexisting energy within the formation can be dedicated for driving natural gas from the formation. The high pressure lift gas is isolated from the producing formation. Removal of the liquid should reduce backpressure on the formation so that high drawdown, and thus increased production, results. Production can be continuous through the annulus which has continuous communication up to the surface, and which provides a flow channel of reduced friction pressure relative to a smaller diameter production tubing, thereby enabling maximum production. It is contemplated that the present invention will increase the ultimate total recovery from the formation and the rate at which the recovery is made. This should result in a reduction in the abandonment pressure for a well and an increase in recoverable reserves. Although the present invention is not so limited, a particular implementation of it is particularly suitable for unloading small amounts of liquid from low pressure formations down to about 11,000 feet below the surface.

We have determined that a reservoir having wells equipped with the preferred embodiment apparatus and using the method of the present invention will have its abandonment pressure dropped a minimum of 100 pounds per square inch (psi). We also contemplate that in this reservoir an additional 7.5 billion cubic feet (bcf) of gas can be recovered for each 10 psi reduction in abandonment pressure. Therefore, it is contemplated that the present invention can be used in this reservoir to increase recoverable reserves by 75 bcf.

Therefore, from the foregoing, it is a general object of the present invention to provide a novel and improved apparatus and method for unloading production inhibiting liquid from a well. Other and further objects, features and advantages of the present invention will be readily apparent to those skilled in the art when the following description of the preferred embodiment is read in conjunction with the accompanying drawings.

DETAILED DESCRIPTION OF PREFERRED EMBODIMENT

Figure 1:
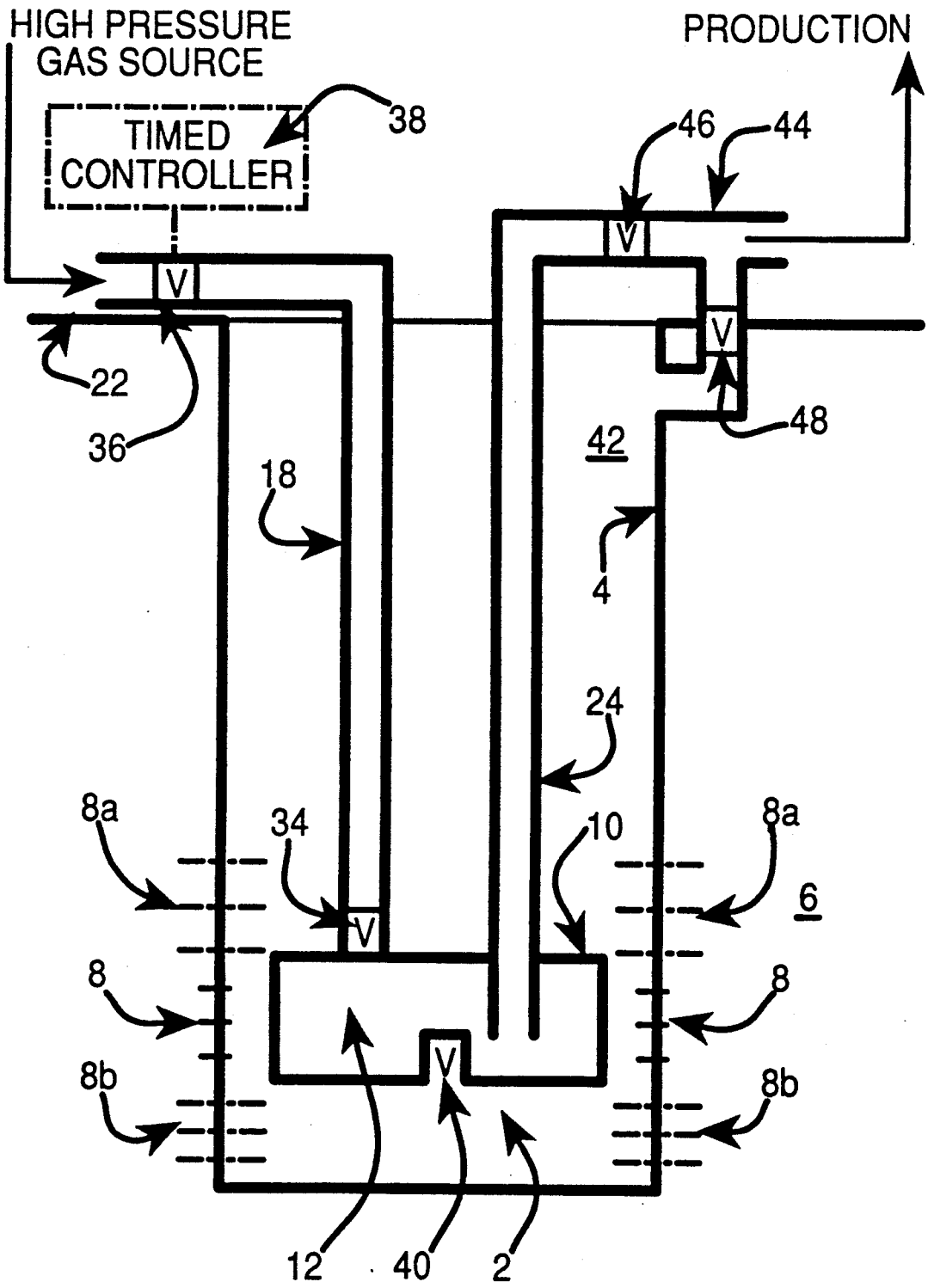
FIG. 1 is a schematic drawing of the preferred embodiment apparatus of the present invention installed in a well intersecting a hydrocarbon-bearing formation.

Referring to FIG. 1, a gas lift apparatus 2 of the present invention is schematically shown as part of an installation in a gas well 4. The well 4 intersects a natural gas-bearing subterranean formation 6. Perforations 8, made in a known manner through the wall of the well 4 as typically defined by a casing or liner (not separately indicated), communicate between the well 4 and the formation 6.

When installed in the well 4, the apparatus 2 is to be used for intermittently removing separate volumes of liquid from the well 4 so that the well 4 is intermittently unloaded of liquid adjacent the formation 6. Unloading the liquid reduces backpressure on the formation 6, thereby permitting increased flow of gas from the formation 6 into the well 4. The unloading accomplished by the present invention is the removal of individual slugs of liquid completely from the well 4 during each unloading, or lift, cycle (such removal is "complete" in the sense that removal occurs all the way out of the well during each cycle; however, a small percentage of the volume of lifted liquid may fall back into the originating body of liquid as known in the art).

The apparatus 2 includes chamber means for receiving liquid from the well 4 and for receiving pressurized gas from outside the well 4. For a natural gas well, the liquid is typically primarily water which has condensed out of gas flowing up the well. This liquid falls to the bottom of the well or section thereof where the chamber means is located. The pressurized gas which the chamber means receives is preferably natural gas produced from another well and pressurized.

Figure 1A:
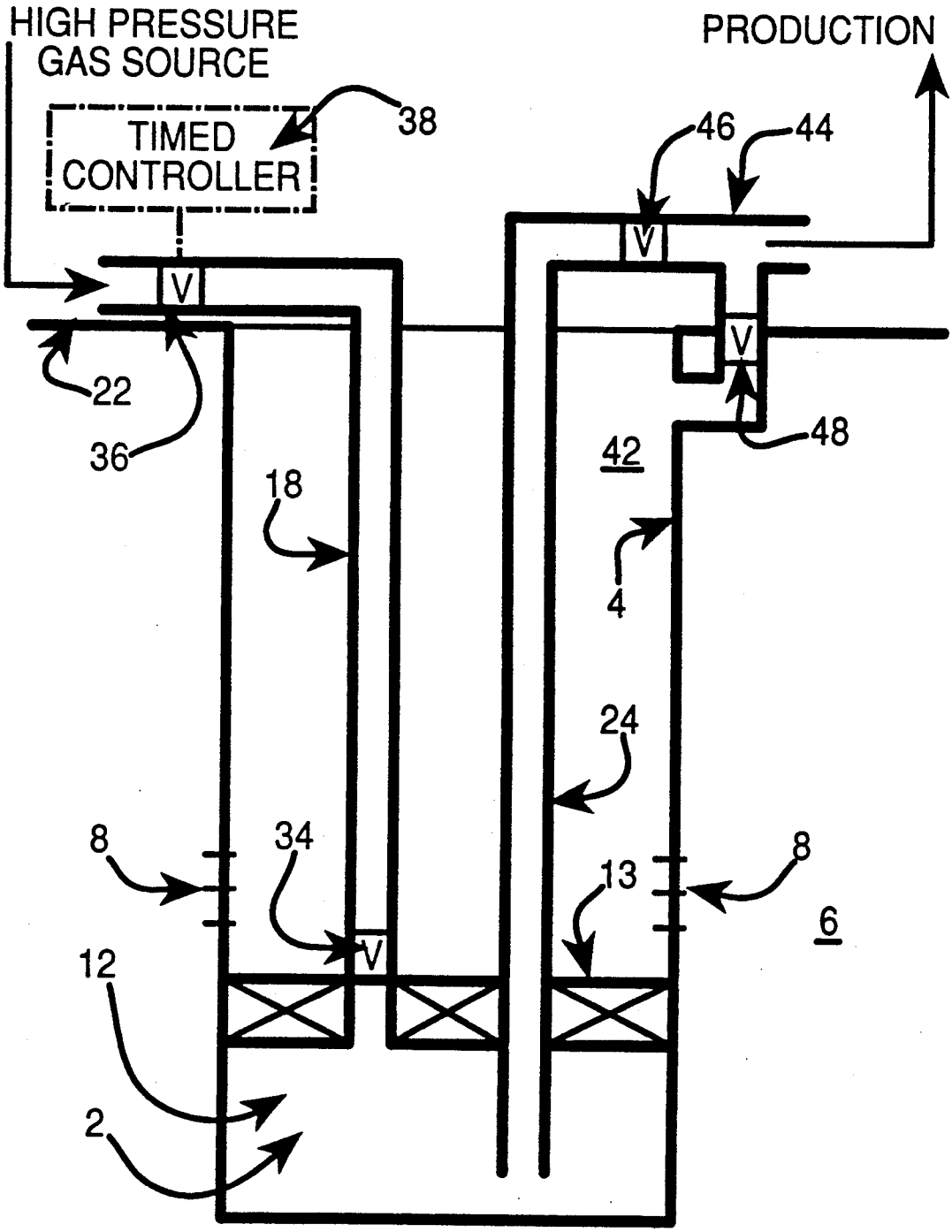
FIG. 1A is a schematic drawing of another embodiment of the apparatus of the present invention.

The chamber means is implemented in the FIG. 1 embodiment by a vessel 10 having a hollow interior defining a chamber 12. It is contemplated that the chamber means can be implemented in other ways. Referring to FIG. 1A, the chamber 12 is defined in the rathole below the perforations 8 by a suitable packer structure 13 and the sides of the well below the packer structure. The packer structure 13 permits, such as via a valve (not shown), liquid to pass into the chamber 12 when pressurized gas is not being injected through an injection tubing string subsequently described.

Referring to the preferred embodiment of FIG. 1, the vessel 10 is any suitable container using a discrete container rather than the well volume between two packers. In the preferred embodiment, the vessel 10 has an upper externally threaded open end for screwing into and communicating with internally threaded end 14 of an adapter 16 shown in FIG. 2. The design of the adapter 16 is based on a portion of a conventional dual packer.

Figure 2:
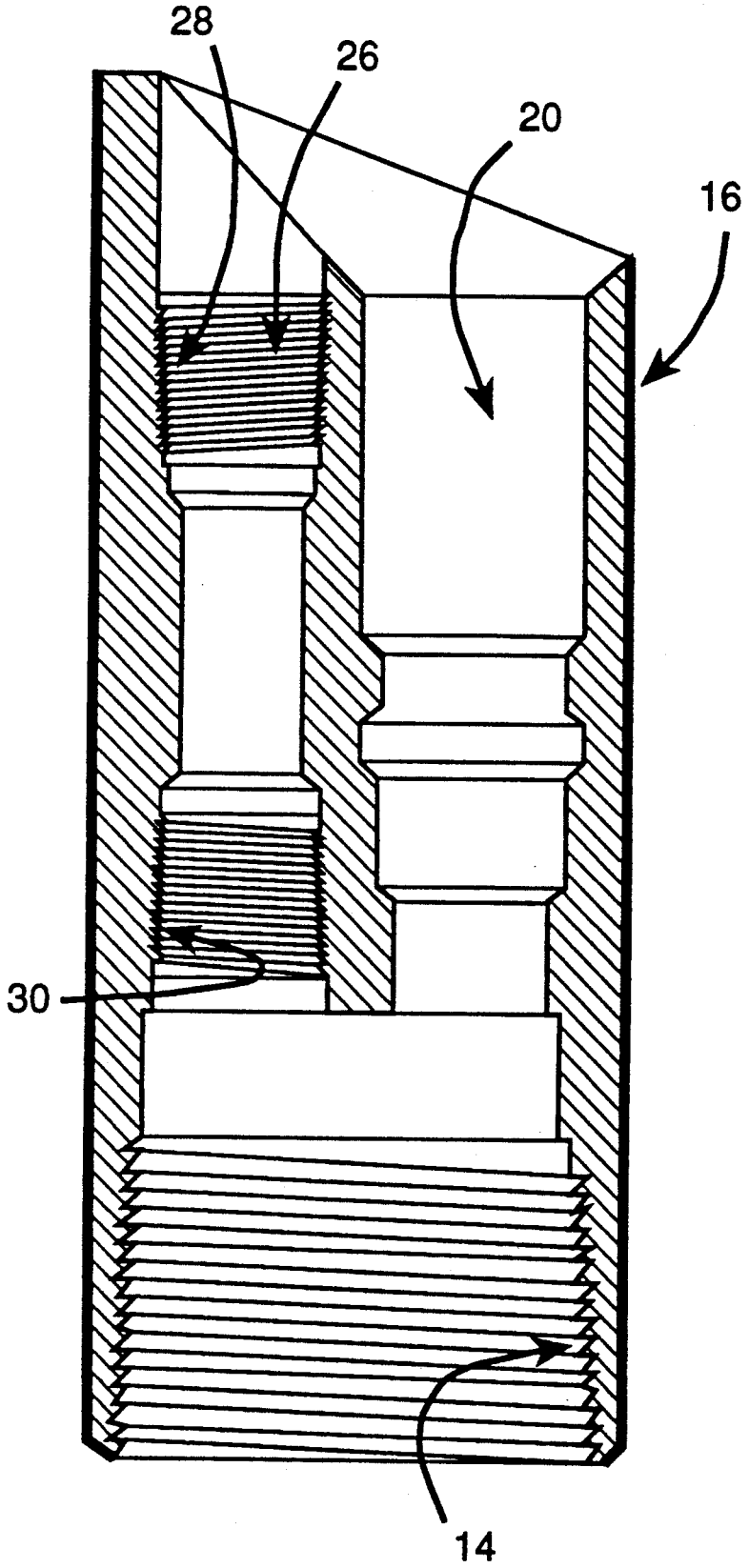
FIG. 2 is a sectional view of a particular implementation of an adapter for connecting two tubing strings to a chamber vessel.

The apparatus 2 includes conductor means for conducting the pressurized gas to the vessel 10 from outside the well 4. In the preferred embodiment, this conductor means includes an injection tubing string 18 (FIG. 1) which connects to the vessel 10 through a cavity 20 of the adapter 16. The cavity 20 is configured as shown in FIG. 2 to provide a collet latch connection with a mating end of the injection tubing string 18; this allows the injection tubing string 18 to be lowered and connected to the vessel 10 after the vessel 10 has already been lowered into the well 4. The injection tubing string 18 is any type suitable for conducting a fluid under high pressure from equipment at the surface 22 to the vessel 10. In the preferred embodiment, it is contemplated that either a string of connected rigid pipe sections or a coiled tubing string can be used to implement the tubing string 18.

The apparatus 2 includes another conductor means. This conductor means conducts liquid from the chamber 12 out of the well 4 in response to the chamber 12 receiving pressurized gas through the tubing string 18. In the preferred embodiment, this conductor means includes a production tubing string 24 (FIG. 1) which connects to the vessel 10 through a cavity 26 of the adapter 16 (FIG. 2). In the preferred embodiment, it is contemplated that either a string of connected rigid pipe sections or a coiled tubing string can be used to implement the production tubing string 24.

The cavity 26 of the adapter 16 has an upper threaded end 28 which couples with a mating end of the production tubing string 24. This allows the tubing string 24 to be connected at the surface to the vessel 10 via the adapter 16 so that the vessel 10 can be lowered into the well on only the production tubing string 24. The injection tubing string 18 can be connected subsequently as described above. This can simplify the installation of the dual string gas lift apparatus relative to prior dual string gas lift apparatus which require both strings to be lowered into the well simultaneously. It is to be noted that other types of connections can be made between the vessel 10 and the tubing strings 18, 24 and that the vessel 10 can be lowered on the injection tubing string 18 and subsequently connected to the production tubing string 24.

Figure 3:
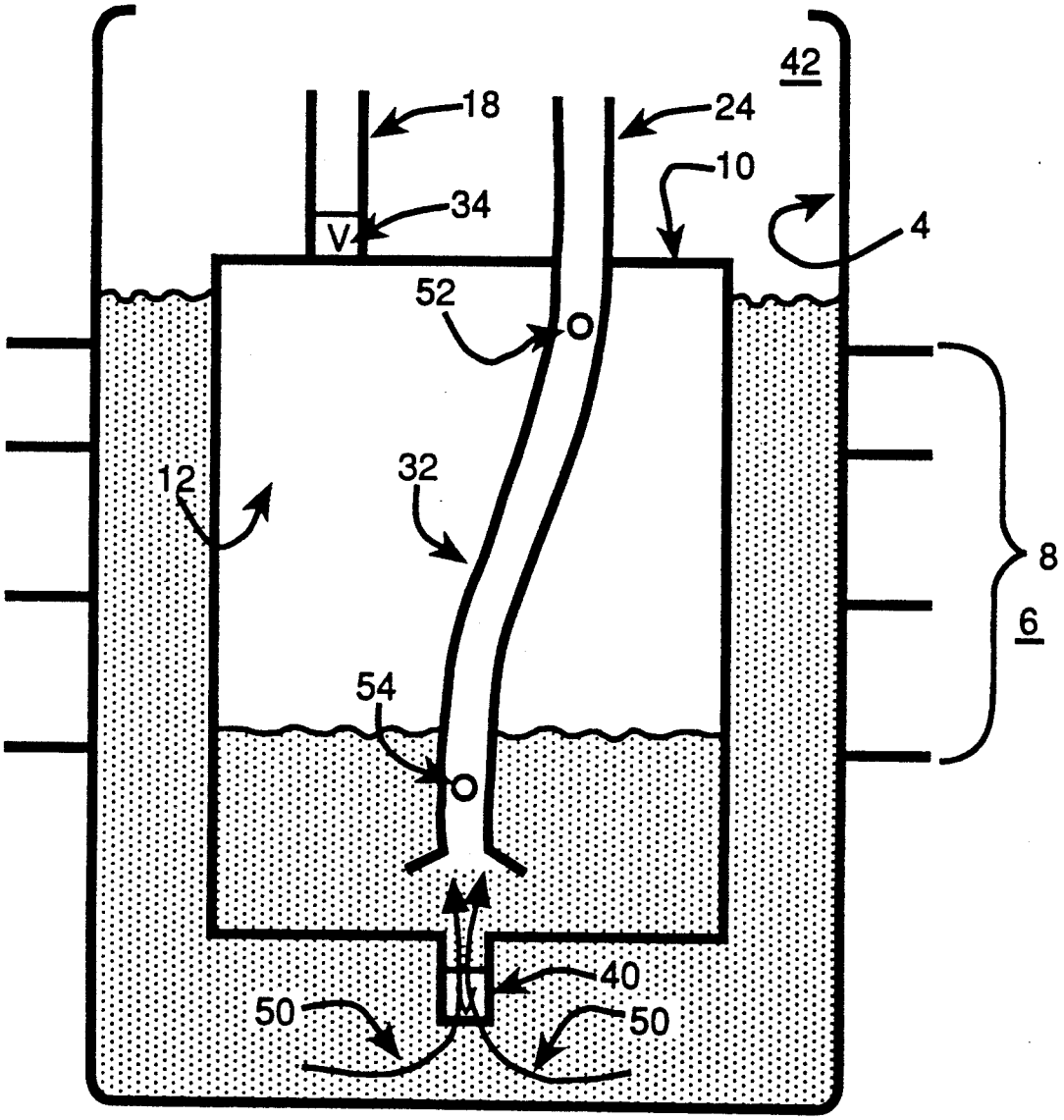
FIG. 3 is a schematic drawing showing the chamber vessel of the apparatus of FIG. 1 during one phase of a lift cycle.
Figure 4:
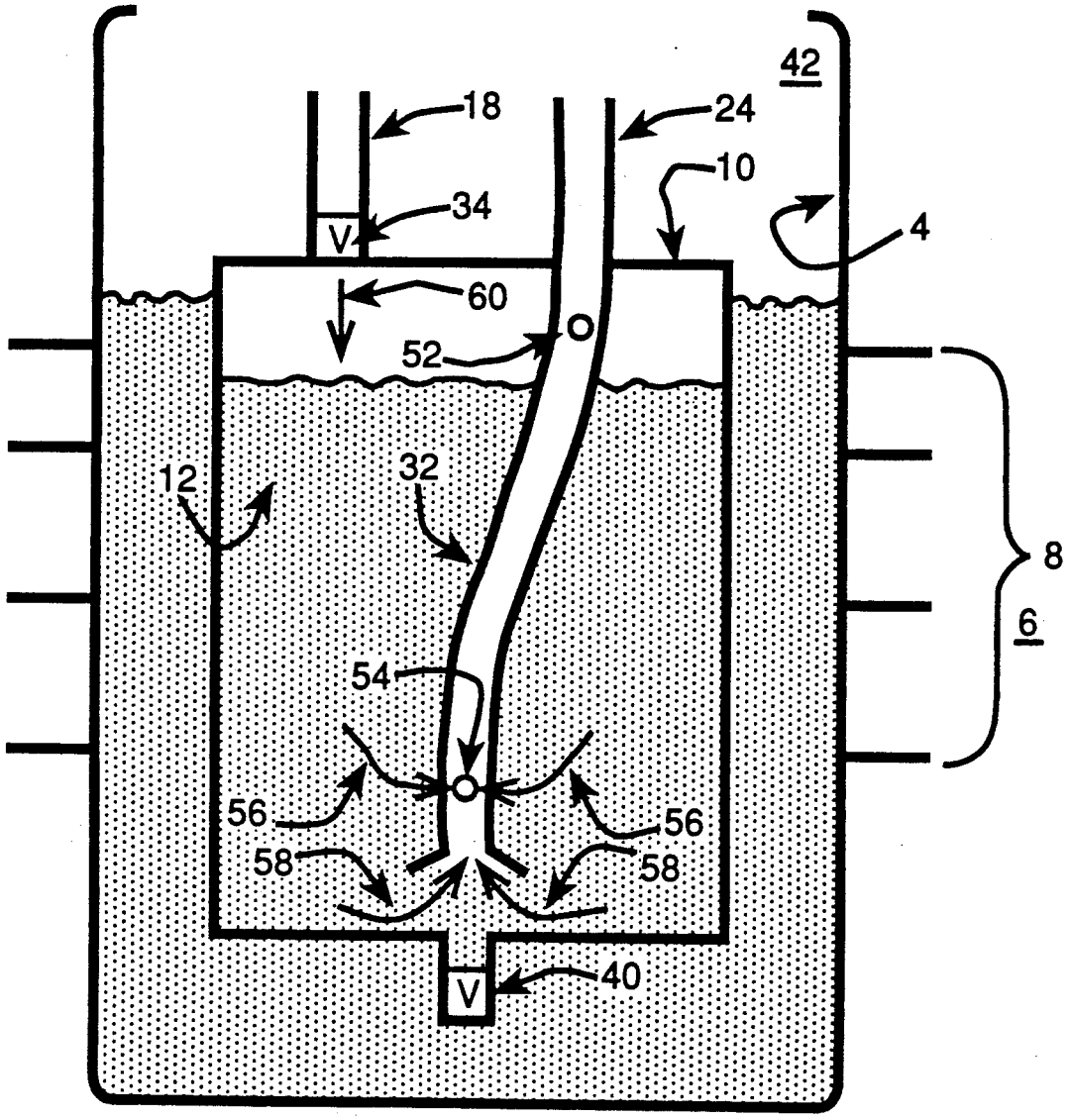
FIG. 4 is a schematic drawing showing the chamber vessel during another phase of the lift cycle.
Figure 5:
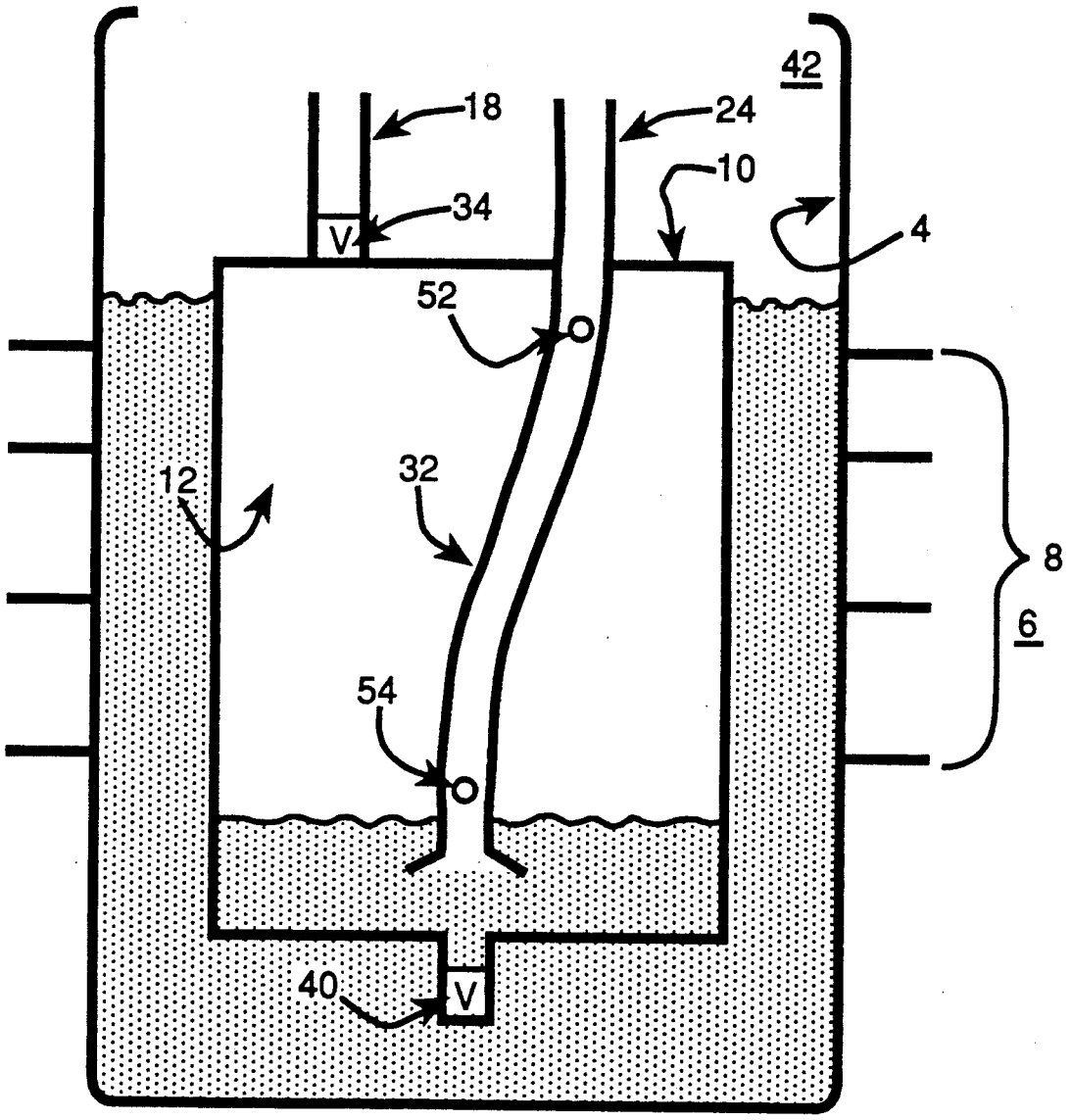
FIG. 5 is a schematic drawing showing the chamber vessel during a further phase of the lift cycle.

In the embodiment shown in FIG. 2, the cavity 26 has a lower threaded end 30 which connects to a lift extension string 32 that extends into the chamber 12 as illustrated in FIGS. 3–5. It is to be noted that the adapter 16 is a relatively inexpensive (at least compared to a mechanical crossover coupling present in at least some prior art disclosures) machined piece having no moving parts to function or malfunction. The cavity 20 simply provides a fluid inlet port and the cavity 26 simply provides a fluid outlet port.

As illustrated in FIG. 1, the injection and production tubing strings 18, 24 are outside each other. That is, in the preferred embodiment one is not nested within the other. The strings 18, 24 can be substantially parallel to each other as illustrated in FIG. 1, or they can be intertwined or otherwise related; provided, however, there are no connections between the tubing strings 18, 24 enabling communication from inside one tubing string to the other except as can occur through the chamber 12. That is, within the well 4 the tubing strings 18, 24 can communicate with each other only through the chamber 12 so that their interiors are otherwise in fluid isolation from each other. Therefore, there are no space requirements for intervening gas lift valves or other couplings so that the tubing strings 18, 24 can be of maximum diameter to provide for maximum gas and liquid flow rates which give maximum lift efficiency. There are also no intervening structures to be damaged when installing the apparatus 2 in the well 4.

As previously described, having the injection and production tubing strings 18, 24 externally separate from each other gives flexibility in installing the apparatus 2 in the well 4 in that externally separate tubing strings obviate the necessity of running the apparatus into the well 4 with both tubing strings 18, 24 at the same time. For example, the vessel 10 and the tubing string 24 can be connected together through their threaded connections with the adapter 16 and run into the well 4. Subsequently, the tubing string 18 can be run in and stabbed into the adapter 16 via the collet latch connection in the cavity 20.

The apparatus of the preferred embodiment further includes a valve 34. The valve 34 is connected in the injection tubing string 18 adjacent the vessel 10. Specifically, it is located above the adapter 16. The valve 34 is a pressure responsive valve which is normally closed to hold a pressure but which opens to permit pressurized gas to enter the chamber 12 from the injection tubing string 18 in response to a predetermined (based on the design of the valve 34) pressure applied at the surface to the tubing string 18. The valve 34 preferably allows a surge of gas at a lift pressure to enter the chamber 12 immediately upon the valve 34 opening. In the preferred embodiment, the valve 34 is a conventional gas lift valve modified for providing continuous flow through the injection tubing string 18 when the valve 34 is open rather than for providing flow from the well into the injection tubing string 18 or chamber 12. A specific implementation of the gas lift valve 34 is a McMurry Oil Tools model VRNT—STD, with 5/16" port, wireline retrievable valve.

Having the valve 34 adjacent the vessel 10 is advantageous because it minimizes the amount of pressurized gas needed to move the volume of liquid out of the well from the chamber 12. This also prevents loss of pressurized gas via percolation through the liquid in the chamber 12. That is, if the valve 34 were located higher in the tubing string 18 or were not used at all, the resulting column of pressurized gas above the chamber 12 would tend to percolate down through the liquid in the chamber 12 and up the tubing string 24. Locating the valve 34 close to the vessel 10 also provides an immediate pressure differential within the chamber 12 when the valve 34 opens, thereby immediately beginning to drive liquid from the chamber 12.

The apparatus 2 of the preferred embodiment further includes a control valve 36 connected to the injection tubing string 18 above the valve 34. When the control valve 36 is open, gas at a pressure greater than the pressure held by the normally closed valve 34 is communicated below the valve 36 to open the valve 34 and to drive liquid from the chamber 12 and out of the well 4 through the tubing string 24 within a single time period during which the valve 36 is open. Preferably this time period is short, such as less than about thirty minutes, for example, so that the valve 36 and the valve 34 are normally closed longer than they are open. Any suitable valve can be used to implement the valve 36, but a specific implementation is a Kim/Ray, 2"-600 series - RF - SMT -½" port surface motor valve.

Although the valve 36 can be a manually operated valve, it is preferably automatically operated to open intermittently for preset time periods. Such operation can be implemented by any suitable timed controller 38 as can be readily implemented in the art (e.g., crystal-based timing circuit having discrete or integrated circuits). A specific implementation of the controller 38 is a Logic Control, Inc. Logic Model No. 101.

A selected time period is preferably chosen based on the amount of liquid to be expelled and the pressures involved. For example, a thirty minute time period is suitable in a particular application for moving during each period two to five barrels of liquid from the chamber 12, up through about 11,000 feet of the production tubing string 24, and out of the well 4 where the pressure in the production tubing string 24 is about 50 pounds per square inch (psi), the pressure at the perforations 8 is about 450 psi and the pressure applied at the surface through the control valve 36 is about 900 psi.

The apparatus 2 of the preferred embodiment further includes a valve 40 connected to the vessel 10. The valve 40 of the preferred embodiment is a conventional standing valve known in the art. The valve 40 is normally open for permitting liquid in the well 4 to flow into the chamber 12, but it closes for preventing liquid in the chamber 12 from flowing into the well 4 in response to pressure in the chamber 12 exceeding pressure in the well 4. A specific implementation for the valve 40 is a Harbison Fisher, Standard API, 1.78" seating nipple with a pressure equalizing standing valve.

In the preferred embodiment, there is one and only one standing valve 40 in the apparatus 2. This is simpler and less expensive than prior gas lift techniques which call for two standing valves, one as used in the present invention and another to hold in a lift or production tubing string a column of liquid which is not fully expelled during each gas lift cycle. In the present invention, a lifted slug or volume of liquid from the chamber 12 is expelled completely out of the well 4 during each lift cycle.

Although not part of the present invention, FIG. 1 shows a flow circuit at the outlet of the production tubing string 24 and at the upper end of an annulus 42 defined in the well 4 outside the apparatus 2. The flow circuit can be any suitable arrangement for conducting the substances moved out of the well 4 through the production tubing string 24 and the annulus 42. Typically, the fluid from the production tubing string 24 would flow through a separator to separate gas and liquid components. The gas components would then be combined into a production flow with the gas produced out of the annulus 42. This is shown simply in FIG. 1 by the common production line 44 and valves 46, 48 representing appropriate intermediate elements as known in the art.

To use the apparatus 2, it is first installed in the well 4 by lowering it using known hoist equipment. As previously mentioned, the vessel 10 and the adapter 16 can be connected to the production tubing string 24 and lowered into the well 4 before the injection tubing string 18 is lowered and stabbed into its connection with the adapter 16 and vessel 10. In general, either string can be used first or both can be lowered at the same time.

In the preferred embodiment, the apparatus 2 is installed in the well 4 so that the vessel 10, suspended on the tubing strings 18, 24, is adjacent the formation 6. "Adjacent" the formation 6 encompasses below, aligned laterally with, or above the perforations as illustrated in FIG. 1 by the alternative sets of perforations **8*a*, 8, 8*b* respectively. Preferably the vessel 10 is as close to the perforations as mechanically feasible for a given well, and more preferably the vessel 10 is below the perforations (e.g., the relationship between vessel 10 and perforations 8*a* in FIG. 1) to allow for maximum drawdown and thus maximum production. The operation of the apparatus 2 is, however, the same regardless of its positioning within the well 4. This operation will be described with reference to FIGS. 3–5 showing the vessel 10 laterally adjacent the perforations 8**.

Referring to FIG. 3, the production tubing string 24 and the chamber 12 are always in communication with each other through the extension string 32. The chamber 12 and the injection tubing string 18 can communicate through the gas lift valve 34. When the gas lift valve 34 is closed, liquid from the well 4 can flow into the chamber 12 through the standing valve 40 as indicated by arrows 50. As liquid flows into the chamber 12, gas remaining in the chamber 12 from a prior cycle or entering with the liquid vents out of the chamber 12 through one or more bleed ports 52 in the extension string 32.

In the preferred embodiment, the liquid flows into the chamber until the timed controller 38 opens the control valve 36. The controller 38 is preferably set to open the control valve 36 frequently enough to prevent too large of a body of liquid from accumulating either in the lift system or the well. This will allow chamber operation at lower lift pressures to reduce the possibility of overtaxing the gas lift system, and this will reduce the amount of liquid blocking the formation. By appropriately sizing the chamber 12 and the cycle frequency for the control valve 36, the volume of liquid ejected during each cycle can be maximized.

Substantially immediately upon opening the control valve 36, the gas lift valve 34 opens. While closed, the gas lift valve 34 has maintained a pressure applied to it of just less than the pressure required to open it (as subsequently described, this occurs when the control valve 36 closes and the pressure in the injection tubing string 18 dissipates until the differential between this pressure and the pressure in the chamber 12 is below the operating pressure of the gas lift valve 34). With the opening of the control valve 36, this maintained pressure is quickly increased above the threshold of the gas lift valve 34 due to the high pressure gas from the source to which the control valve 36 is connected. The source of high pressure gas is any suitable source known in the art. In a particular application, the source can be from other wells and processing equipment in the area of the well 4.

When the gas lift valve 34 opens, the pressurized gas is injected into the chamber 12 through the injection tubing string 18. The pressure in the chamber 12 now exceeds the pressure in the well 4 so that the standing valve 40 closes to prevent the pressure from acting on the well 4 and to prevent loss of liquid which has been collected in the chamber 12.

The pressure in the chamber 12 also lifts liquid in the chamber 12 out of the well 4 through the production tubing string 24 during the limited time that the control valve 36, and thus the gas lift valve 34, are open. The lifted liquid flows from the chamber 12 into the production tubing string 24 through one or more ports 54 near the lower end of the extension string 32 or through the end of the extension string 32. This movement of the liquid is indicated in FIG. 4 by the arrows 56 and 58, and the pressure force is indicated by the arrow 60. Check valves (not shown) in the bleed port(s) 52 close to prevent liquid escaping through the bleed port(s) 52.

The lifted liquid is moved completely out of the well 4 during this phase of the lift cycle. That is, no column of liquid is built up within the production tubing string 24. Thus, slugs of liquid are intermittently ejected from the chamber 12 completely out of the well 4. This simplifies the lifting process because it eliminates the need for a standing valve or intermediate lift valves along the production tubing string 24. Lifting occurs in the preferred embodiment of the present invention solely in response to the lift pressure in the chamber 12 resulting from the pressurized fluid entering the chamber 12 from the injection tubing string 18 during a lift cycle, which cycle is preferably intermittently repeated so that the lifting occurs intermittently and not continuously.

In the preferred embodiment, the control valve 36 is closed after a limited time period as set in the timed controller 38. The limited time period should be long enough to allow for complete lifting of the liquid slug out of the well 4. In a particular application, this time period can be less than about thirty minutes (preferably, within the range between about ten minutes and about thirty minutes).

When the control valve 36 closes, the gas lift valve 34 ultimately closes once the pressure in the injection tubing string 18 sufficiently decreases so that the pressure across the gas lift valve 34 is less than its operating pressure differential. In a particular implementation, the injection pressure is about 900 psi; and once the control valve 36 is closed, the pressure in the injection tubing string 18 decreases to about 550 psi and the pressure in the chamber 12 and production tubing string 24 decreases to about 50 psi after a volume of liquid has been lifted so that the differential across the gas lift valve 34 is about 500 psi, at which differential the gas lift valve 34 closes. This phase of the lift cycle is illustrated in FIG. 5 wherein the liquid level in the chamber 12 has been lowered due to the volume of liquid which has just been lifted and wherein the gas lift pressure has bled off through the ports in the extension string 32 down to substantially the pressure in the production line 44. The apparatus is ready to again receive liquid from the well and repeat the lift cycle.

Through repetition of the lift cycle, the valves 40, 36 and 34 are intermittently opened and closed and liquid is intermittently lifted out of the well 4 to unload the liquid in the well adjacent the formation 6. During each cycle, gas is preferably continuously produced from the formation 6 through at least the annulus 42. However, the valve 48 can be closed if desired or necessary during at least part of the lift cycle.

The apparatus 2 thus acts as a downhole separator, allowing liquid to fall back from the gas flow stream in the larger annulus 42 and to be lifted out through the production tubing string 24. This allows relatively dry gas to flow up the annulus 42. Annular flow minimizes friction pressure, and annular flow enables a well to produce continuously. Reducing (if not eliminating) the volume of liquid remaining in the annulus 42 against the formation perforations 8 by lifting slugs of liquid as described above lowers the hydrostatic pressure on the formation 6, thereby increasing drawdown and, consequently, production. This is accomplished in the relatively simplified manner of the present invention, which simplicity should tend to maximize operating life of the present invention.

As particularly described, the present invention is a means to de-water vertical gas wells. Such a specific application to which the preferred embodiment is particularly suited is in a field having a functioning high pressure gas source and delivery pipeline in place and having gas wells (1) of sufficient diameter to receive the apparatus 2 with an adequate size of vessel 10, (2) of high productivity index and low bottom hole pressure, and (3) of sufficient depth that other techniques, such as beam lift, are not suitable but where gas lift as implemented by the present invention can still economically function. As to criterion (3), a minimum depth can be determined by comparing the economics and inefficiencies of other techniques to the present invention, and a maximum depth can be determined by considering the volume of liquid to be lifted and the amount and pressure of lift gas that can be provided. In a specific implementation, economic lifting with the present invention at depths between about 9,000 feet and about 11,000 feet has been achieved; however, it is contemplated that the present invention can be used at other depths. The gas wells also preferably have ratholes below existing perforations to allow vessels 10 (or other chamber means) to be set below the perforations to minimize the fluid columns above the perforations during production.

To exemplify the invention even more specifically, lists of specific components which have been used are given below; however, these are not to be taken as limiting the scope of the present invention. That is, the present invention is not limited to specific sizes or pieces of equipment although specific ones may be preferable in a particular well. For example, the inner diameters of the injection tubing string 18 and the production tubing string 24 can be the same or different, with either tubing string larger than the other. In a particular well, one of these diametric relationships may be preferable whereas in a different well another of these relationships may be preferable (e.g., if large lift volume is desired, a larger inner diameter production tubing string might be used; whereas if it is desired to try to produce under existing reservoir pressure, then a smaller inner diameter production tubing string might be used).

The following components have been used for running the outer shell by which the chamber vessel is defined. Tubing thread is 2⅜" EUE-8RD. Detail is from bottom to top.

1) 1-1.625" Baker "F" seating nipple, thread with 2⅜" box up
2) 2-6'×2⅜" pup joints
3) 1-2⅜"×1.78" API seating nipple
4) 1-equalizing standing valve, 1⅛" ball ×15/16" seat, 1.86" no-go maximum outer diameter
5) 1-2'×2⅜" pup joint
6) 1-2⅜" pin down×4½" ST/L box up (ST/L to be cut for 11.6# casing), X-over, +/−1'
7) 6-40' joints (total 240') 4½", 11.6#, K-55 ST/L FJ casing
8) 1-4½" ST/L pin down×5½", 14#, FL4S box up, X-over, +/−2'
9) 1-40'×5½", 14#, L-80, joint casing with 5½", FL4S pin down×5½", buttress pin up The following components have been used for running the inner extension string, or siphon tube, of the chamber. Tubing thread is 2⅜" EUE-8RD. Detail is from bottom to top.

1) 1-2⅜" wireline guide
2) 1-2'×2⅜" pup joint
3) 1-2⅜"×1.87" Baker "F" seating nipple
4) 1-8'×2⅜" pup joint - pup to have 1-2⅜"×3.75" centralizer at top and bottom
5) 1-4'×2⅜" perforated sub
6) 7-30' joints 2⅜", 4.7#, K-55 tubing
7) 1-2⅜" pup joint to space out wireline guide approximately 2' above bottom of chamber. Back off coupling on top pup so joint is pin up x pin down 8) 1-2⅜" gas lift mandrel, with wireline retrievable double valve orifice, gas lift mandrel is box x box, equalizing port 9) 1-30' joint 2⅜", 4.7#, K-55 tubing, with coupling removed (pin up x pin down)

10) 1- dual tubing head with 2⅜" "collet latch" for receiving injection tubing string and 2⅜" box x box threaded to production tubing string. Head to have 5½" buttress box down.

Although the present invention is useful in the aforementioned particular applications, the present invention can be used with other fluids and in other applications. For example, it is contemplated that the present invention can be used with horizontal wells and with tight gas formations.

Thus, the present invention is well adapted to carry out the objects and attain the ends and advantages mentioned above as well as those inherent therein. While a preferred embodiment of the invention has been described for the purpose of this disclosure, changes in the construction and arrangement of parts and the performance of steps can be made by those skilled in the art, which changes are encompassed within the spirit of this invention as defined by the appended claims.

What is claimed is:

1. A gas lift apparatus for installation in a well extending into the ground from the surface and intersecting a natural gas-bearing formation below the surface for intermittently removing separate volumes of liquid from the well for increasing the flow of natural gas from the formation into the well, comprising:

chamber means for receiving liquid from the well and for receiving pressurized gas from outside the well;

an injection tubing string for conducting pressurized gas to said chamber means from outside the well to provide a lift pressure in said chamber means, said injection tubing string connected to said chamber means; and a production tubing string, connected to said chamber means, for conducting liquid from said chamber means out of the well in response to said lift pressure, said injection and production tubing strings disposed outside each other so that said injection and production tubing strings communicate with each other in the well only through said chamber means, wherein said chamber means is adapted for being lowered into the well on only one of said injection tubing string and said production tubing string and for being subsequently connected in the well with the other of said injection tubing string and production tubing string.

2. A gas lift apparatus as defined in claim 1, wherein said chamber means includes a portion of the well packed off below the formation.

3. A gas lift apparatus as defined in claim 1, wherein said chamber means includes a vessel suspended in the well adjacent the formation on said injection and production tubing strings and having a chamber defined therein.

4. A gas lift apparatus as defined in claim 3, wherein:

said gas lift apparatus further comprises a valve connected to said vessel, said valve normally open for permitting liquid in the well to flow into said chamber, and said valve adapted to close for preventing liquid in said chamber from flowing into the well in response to pressure in said chamber exceeding pressure in the well; and said injection and production tubing strings suspend said vessel in the well so that there is fluid communication in the well outside said injection and production tubing strings from the formation to the surface for permitting gas production through the well, and further wherein said injection tubing string and said production tubing string connect to said vessel for intermittently producing separate volumes of liquid from said chamber to the surface through said production tubing string solely in response to said lift pressure being applied intermittently in said chamber as a result of pressurized gas intermittently entering said chamber from said injection tubing string.

5. A gas lift apparatus as defined in claim 4, further comprising a gas lift valve connected in said injection tubing string near said vessel and normally closed for holding a pressure so that a surge of gas at said lift pressure immediately enters said chamber when said gas lift valve opens.

6. A gas lift apparatus as defined in claim 5, further comprising a control valve connected to said injection tubing string above said gas lift valve and normally closed for holding a pressure greater than the pressure held by said gas lift valve so that said gas lift valve opens and said lift pressure is provided in said chamber in response to said greater pressure when said control valve opens.

7. A gas lift apparatus as defined in claim 6, wherein said control valve opens intermittently for time periods such that said control valve is closed longer than it is open.

8. A gas lift apparatus as defined in claim 7, wherein each of said time periods does not exceed about thirty minutes and wherein said injection and production tubing strings are at least 9,000 feet long.

9. A gas lift apparatus as defined in claim 1, further comprising:

a pressure responsive valve connected to said injection tubing string adjacent said chamber means; and a timer-controlled valve connected to said injection tubing string above said pressure-responsive valve so that when said timer-controlled valve opens, pressurized gas is communicated below said timer-controlled valve for opening said pressure-responsive valve and for driving liquid from said chamber means and out of the well through said production tubing string within a single time period during which said timer-controlled valve is open.

10. A gas lift apparatus as defined in claim 9, wherein said timer-controlled valve intermittently opens for less than about thirty minutes at a time and wherein each of said injection and production tubing strings has a length of at least about 9,000 feet.

11. A gas lift apparatus as defined in claim 1, further comprising a gas lift valve connected to said injection tubing string.

12. A gas lift apparatus as defined in claim 11, further comprising one, and only one, standing valve connected to said chamber means.

13. A gas lift apparatus as defined in claim 12, further comprising a control valve connected to said injection tubing string above said gas lift valve.

14. A gas lift apparatus as defined in claim 1, wherein said chamber means and said injection and production tubing strings are positioned in the well so that said chamber means is below perforations in the formation and so that there is communication within the well from the perforations to the surface.

15. A method of gas-lifting liquid from a well extending into the ground from the surface and intersecting a natural gas-bearing formation below the surface for intermittently removing separate volumes of liquid from the well for increasing the flow of natural gas from the formation into the well while permitting production of natural gas through the well, comprising:

lowering from the surface a liquid-containing chamber into the well to a location adjacent to the natural gas-bearing formation by using only one of an injection tubing string and a production tubing string;

subsequently lowering from the surface and connecting to the chamber the other of said injection tubing string and said production tubing string;

injecting, for a limited time period and through said injection tubing string extending from the surface, pressurized gas into a liquid-containing chamber located in the well adjacent the formation and connected to the injection tubing string;

lifting, in response to the injected pressurized gas and during the limited time period, liquid in the chamber out of the well through said production tubing string connected to the chamber, which production tubing string and injection tubing string are located outside of each other and in fluid isolation from each other within the well except through the chamber; and producing natural gas from the formation through the well outside the injection and production tubing strings.

16. A method as defined in claim 15, wherein pressurized gas in injected in response to a timer-controlled valve and a pressure-responsive valve in the injection tubing string opening.

17. A method as defined in claim 16, wherein the timer-controlled valve is intermittently opened for limited time periods.

18. A method as defined in claim 17, wherein the limited time periods are less than about thirty minutes each and wherein fluid lifted out of the well is lifted at least 9,000 feet during each limited time period.

19. A method of gas-lifting liquid from a well extending into the ground from the surface and intersecting a natural gas-bearing formation below the surface for intermittently removing separate volumes of liquid from the well for increasing the flow of natural gas from the formation into the well, comprising:

establishing in the well a chamber for receiving liquid which has condensed and fallen out of natural gas flowing up the well, wherein the chamber is established in the well by lowering a vessel into the well on only one of a injection tubing string and a production tubing string that extends to the surface;

subsequently lowering from the surface and connecting the other tubing string of the chamber;

injecting, for a limited time period and through said injection tubing string extending from the surface to the chamber, pressurized gas into the chamber;

lifting, in response to the injected pressurized gas and during the limited time period, liquid in the chamber out of the well through said production tubing string connected to the chamber, wherein said production tubing string and said injection tubing string are located outside of each other and in fluid isolation from each other within the well through the chamber.

20. A method as defined in claim 19, further comprising producing natural gas from the formation through the well outside the injection and production tubing strings.

21. A method as defined in claim 19, wherein pressurized gas is injected in response to a timer-controlled valve and a pressure-responsive valve in the injection tubing string opening.

22. A method as defined in claim 21, wherein the timer-controlled valve is intermittently opened for limited time periods.

23. A method as defined in claim 22, wherein the limited time periods are less than about thirty minutes each and wherein fluid lifted out of the well is lifted at least 9,000 feet during each limited time period.

24. A method as defined in claim 19, wherein the chamber is established in a rathole of the well below perforations communicating between the well and the formation.

* * * * *